United States Patent [19]

Carlson et al.

[11] 4,248,694

[45] Feb. 3, 1981

[54] PROCESS FOR TREATING A SOUR PETROLEUM DISTILLATE

[75] Inventors: David H. J. Carlson, Park Ridge; Peter Urban, Northbrook, both of Ill.

[73] Assignee: UOP Inc., Des Plaines, Ill.

[21] Appl. No.: 39,912

[22] Filed: May 17, 1979

[51] Int. Cl.[3] ..... C10G 19/02

[52] U.S. Cl. ..... 208/206; 208/207

[58] Field of Search ..... 208/206, 207

[56] References Cited

U.S. PATENT DOCUMENTS

| | | | |
|---|---|---|---|
| 3,108,081 | 10/1963 | Gleim et al. | 208/206 |
| 3,408,287 | 3/1980 | Urban et al. | 208/206 |
| 4,009,120 | 2/1977 | Hilfman | 208/206 |
| 4,033,860 | 7/1977 | Carlson | 208/206 |

*Primary Examiner*—Herbert Levine

*Attorney, Agent, or Firm*—James R. Hoatson, Jr.; Robert W. Welch; William H. Page, II

[57] ABSTRACT

A process for treating a mercaptan-containing sour petroleum distillate is disclosed. The distillate is treated in contact with a solid composite prepared by impregnating high density activated charcoal particles with a metal phthalocyanine catalyst from an aqueous solution thereof.

7 Claims, No Drawings

PROCESS FOR TREATING A SOUR PETROLEUM DISTILLATE

Processes for treating a sour petroleum distillate wherein said distillate is passed in contact with a supported metal phthalocyanine catalyst disposed as a fixed bed in a treating or reaction zone, have become well known and widely accepted in the petroleum refining industry. The treating process is typically designed to effect the catalytic oxidation of offensive mercaptans contained in the sour distillate with the formation of innocuous disulfides. The oxidizing agent is most often air admixed with the sour distillate to be treated. Gasoline, including natural, straight run and cracked gasoline, is the most frequently treated sour petroleum distillate. Other sour petroleum distillates include the normally gaseous petroleum fractions as well as naphtha, kerosene, jet fuel, fuel oil, lube oil, and the like.

U.S. Pat. No. 3,108,081 discloses a solid composite of an activated charcoal and a catalytic amount of a phthalocyanine catalyst, e.g., a cobalt phthalocyanine sulfonate, useful for treating a sour petroleum distillate as herein contemplated. In general, the monosulfonate is preferred. It is apparent from the description that the particulate activated charcoal employed therein was of relatively low apparent bulk density, about 0.15 grams per cubic centimeter, although the patent does not emphasize any particular physical property of the charcoal as influencing the performance of the solid composite. A method of preparing the solid composite wherein the activated charcoal particles are impregnated with a metal phthalocyanine from an aqueous solution thereof is also disclosed. However, although impregnation from a methanolic solution has become increasingly objectionable in that methanol is relatively expensive, toxic and difficult to dispose of, impregnation from said solution has heretofore produced a most active solid composite and has been preferred from as early as U.S. Pat. No. 2,853,432 to as recent as U.S. Pat. No. 4,141,819.

It has now been found that in the process of impregnating activated charcoal particles with a metal phthalocyanine, the activity of the resulting solid composite is improved substantially when the charcoal particles are of relatively high apparent bulk density and, more importantly, said improvement persists when said impregnation is from an aqueous solution or dispersion of said metal phthalocyanine.

It is therefore an object of this invention to present a process for treating a mercaptan-containing sour petroleum distillate and, in one of its broad aspects, said invention embodies a process which comprises contacting said distillate with metal phthalocyanine-impregnated activated charcoal particles in the presence of an alkaline reagent at oxidation conditions, said activated charcoal particles having an apparent bulk density of from about 0.25 to about 0.50 grams per cubic centimeter, and said metal phthalocyanine having been impregnated on said activated charcoal particles from an aqueous solution or dispersion thereof.

Another embodiment of this invention concerns a process for treating a mercaptan-containing sour petroleum distillate which comprises contacting said distillate with cobalt phthalocyanine sulfonate-impregnated activated charcoal particles in the presence of an alkaline reagent at oxidation conditions, said activated charcoal particles having an apparent bulk density of from about 0.4 to about 0.5 grams per cubic centimeter, and said cobalt phthalocyanine sulfonate having been impregnated on said activated charcoal partlicles from an aqueous solution thereof.

One of the more specific embodiments relates to a process which comprises contacting a sour petroleum distillate with cobalt phthalocyanine sulfonate-impregnated activated charcoal particles in the presence of an alkaline reagent at oxidation conditions, said activated charcoal particles having an apparent bulk density of from about 0.4 to about 0.5 grams per cubic centimeter, said cobalt phthalocyanine sulfonate comprising mono- and disulfonate in a molar ratio of from about 0.5:1 to about 1.5:1, and said cobalt phthalocyanine sulfonate having been impregnated on said activated charcoal particles from an aqueous ammoniacal solution thereof.

Other objects and embodiments of this invention will become apparent in the following detailed specification.

Pursuant to the process of the invention, a mercaptan-containing sour petroleum distillate is treated in contact with metal phthalocyanine-impregnated activated charcoal particles in the presence of an alkaline reagent at oxidation conditions. Any suitable alkaline reagent may be employed, although an aqueous caustic solution is preferred. Other suitable alkaline reagents particularly include aqueous potassium hydroxide solutions, but also aqueous solutions of lithium hydroxide, rubidium hydroxide, and cesium hydroxide.

The process is usually effected at ambient temperature conditions although elevated temperatures generally not in excess of about 300° F. may be used. The process can be effected at a pressure of up to about 1000 psi. or more, although atmospheric, or substantially atmospheric, pressures are entirely suitable. A contact time equivalent to a liquid hourly space velocity of from about 1 to about 100 or more is effective to achieve a desired reduction in the mercaptan content of a sour petroleum distillate, an optimum contact time being dependent on the size of the treating zone, the quantity of metal phthalocyanine-impregnated charcoal particles contained therein, and the particular sour petroleum distillate being treated.

As previously stated, sweetening of the sour petroleum distillate is effected by oxidizing the mercaptan content thereof to disulfides. Accordingly, the process is effected in the presence of an oxidizing agent, preferably air, although oxygen or other oxygen-containing agents may be employed. The mixture of petroleum distillate, alkaline reagent and oxidizing agent is passed upwardly or downwardly through the catalyst bed. In some cases, the air may be passed countercurrent to the petroleum distillate and still other cases, the petroleum distillate and alkaline reagent may be introduced separately into the treating zone.

The metal phthalocyanine-impregnated activated charcoal particles of this invention are characterized by a relatively high apparent bulk density. The activated charcoal particles comprise the various charcoals produced by the destructive distillation of wood, peat, lignite, nut shells, bones, and other carbonaceous matter, which have been heated and/or chemically treated to form highly porous charcoal particles of increased adsorbent capacity and having an apparent bulk density of from about 0.25 to about 0.5 grams per cubic centimeter. Preferably, the activated charcoal particles have an apparent density of from about 0.4 to about 0.5 grams per cubic centimeter.

As heretofore mentioned, the improved activity of the solid composite of this invention, attributes to the use of high density activated charcoal particles, persists when the metal phthalocyanine catalyst is impregnated on the activated charcoal particles from an aqueous solution thereof, and such is preferred. In some cases, solubility of the metal phthalocyanine in water is facilitated by incorporating ammonia or ammonium hydroxide in the impregnating solution, generally in small amounts not exceeding about 20 volume percent. The activated charcoal particles may be impregnated with the metal phthalocyanine in any conventional or otherwise convenient manner. In general, the charcoal particles are dipped, soaked, suspended, or otherwise immersed in the aqueous impregnating solution or dispersion, or the aqueous solution or dispersion may be sprayed onto, poured over, or otherwise contacted with the charcoal particles. In any case, the excess solution and/or dispersion is separated and the resulting composite allowed to dry under ambient temperature conditions, or dried at an elevated temperature in an oven, in a flow of hot gases, or in any other suitable manner.

It is generally preferable to impregnate as much metal phthalocyanine on the charcoal particles as will form a stable catalytic composite, although a lesser amount in the range of from about 0.1 to about 10 wt.% affords a suitably active catalytic composite. One convenient method of preparation comprises passing the aqueous metal phthalocyanine solution and/or dispersion through a bed of the charcoal particles predisposed in a sour petroleum distillate treating zone in order to form the catalytic composite in situ. This method allows the solution and/or dispersion to be recycled one or more times to achieve a desired concentration of the metal phthalocyanine on the charcoal particles. In still another method, the charcoal particles may be predisposed in said treating chamber and the chamber thereafter filled with an aqueous metal phthalocyanine solution and/or dispersion to soak the particles for a predetermined period, thereby forming the catalytic composite in situ.

The activated charcoal particles of this invention are advantageously impregnated with any of the various metal phthalocyanines, for example, magnesium, titanium, hafnium, vanadium, tantalum, molybdenium, manganese, iron, cobalt, nickel, platinum, palladium, copper, silver, zinc and tin phthalocyanine, and the like. Cobalt phthalocyanine and vanadium phthalocyanine are particularly preferred. The metal phthalocyanine is typically employed as a derivative thereof, the commercially available sulfonated derivatives, for example, cobalt phthalocyanine monosulfonate, cobalt phthalocyanine disulfonate, or mixtures thereof being preferred. Cobalt phthalocyanine mono- and disulfonates in a molar ratio of from about 0.5:1 to about 1.5:1 has resulted in a solid composite of improved activity over that of a prior art solid composite comprising cobalt phthalocyanine, mono- and disulfonate in a 4.1 molar ratio, and the aforementioned molar ratio is particularly preferred.

In many cases, the sour petroleum distillate, and especially gasoline, is first treated with an alkaline reagent solution in order to remove a major portion of the mercaptan prior to further treating in the manner hereinbefore described. Any suitable alkaline reagent, and particularly sodium hydroxide or potassium hydroxide, is utilized. This removes a major portion of the mercaptans but leaves a distillate which is still sour. Further conversion of the mercaptans is effected in the presence of the catalytic composite herein described.

The catalyst composite prepared in accordance with the method of this invention is both active and stable. Accordingly, the catalytic composite may be employed in a fixed bed for the treatment of large volumes of sour petroleum distillate. Although the metal phthalocyanine is somewhat soluble in alkaline solution, it is nevertheless retained on the solid adsorbent support. However, in the event that any of the metal phthalocyanine is leached from the support, or otherwise carried away in the alkaline solution, it may be readily recycled in said solution for reuse in the sweetening process. However, it is in some cases desirable to introduce additional metal phthalocyanine for adsorption on the solid support in the manner herein described.

The following examples are presented in illustration of certain preferred embodiments of this invention and are not intended as an undue limitation on the generally broad scope of the invention as set out in the appended claims.

EXAMPLE I

An impregnating solution was prepared by initially adding 150 mg of cobalt phthalocyanine mono- and disulfonates to 5 ml of methanol, said mono- and disulfonates being in a molar ratio of about 1:1. After about 5 minutes of stirring, the solution was diluted to about 305 ml with methanol. The solution was then further stirred for about 5 minutes after which 100 cm of 10×30 mesh activated charcoal particles were immersed in the solution. The charcoal particles (Nuchar WA) had an apparent bulk density (ABD) of 0.15 g/cc. The resulting mixture was agitated for about 3 minutes after which the impregnating solution was evaporated to dryness in contact with the charcoal particles over a steam bath. The impregnated charcoal particles were subsequently oven-dried at about 212° F. The solid composite thus prepared in hereinafter referred to as Catalyst A.

EXAMPLE II

The solid composite of this example was prepared substantially as described in the previous example except that the activated charcoal particles had an apparent bulk density of 0.44 g/cc (Darco MRX). The particle size was in the 10×30 mesh range. The solid composite of this example is hereinafter referred to as Catalyst B.

EXAMPLE III

In this example, the impregnating solution was prepared by initially adding 150 mg of cobalt phthalocyanine mono- and disulfonates to 5 ml of deionized water, said mono- and disulfonates being in a molar ratio of about 1:1. After about 5 minutes of stirring, the solution was diluted to about 125 ml with deionized water after which 100 cc of 10×30 mesh Nuchar WA activated charcoal particles were immersed in the solution. The charcoal particles had an apparent bulk density of about 0.15 g/cc. The resulting mixture was stirred for about 3 minutes after which the impregnating solution was evaporated to dryness in contact with the charcoal particles over a steam bath. The impregnated charcoal particles were subsequently oven-dried at about 212° F. The solid composite of this example is hereinafter referred to as Catalyst C.

EXAMPLE IV

The solid composite of this example was prepared substantially as described in Example III except that the activated charcoal particles (Darco MRX) had an apparent bulk density of about 0.44 g/cc. The particle size was also in the 10×30 mesh range. The solid composite of this example is hereinafter referred to as Catalyst D.

EXAMPLE V

The solid composite substantially as described in the previous Example III except that the impregnating solution was initially prepared by adding 150 mg of the cobalt phthalocyanine sulfonate to 5 ml of deionized water containing 1 ml of an aqueous ammonium hydroxide solution containing 28% as ammonia ($NH_3$). After about 5 minutes of stirring, the solution was diluted to about 125 ml with deionized water. In all other respects, the preparation was as described in the previous Example III. The solid composite of this example is hereinafter referred to as Catalyst E.

EXAMPLE VI

The solid composite of this example was prepared substantially as described in the previous example except that the activated charcoal particles (Darco MRX) had an apparent bulk density of about 0.44 g/cc. The particle size was again in the 10×30 mesh range. The solid composite of this example is hereinafter referred to as Catalyst F.

The above described catalysts were each evaluated with respect to a sour kerosene fraction containing 832 ppm mercaptan sulfur. In each case, 13.3 cubic centimeters of the catalyst, wetted with 5 ml of 10° Baumé agueous NaOH, and 100 cubic centimeters of the sour kerosene were contained in a closed glass vessel with air at ambient conditions of temperature and pressure, and the glass vessel was inserted in a mechanical shaking device. The sour kerosene was shaken in contact with the catalyst particles and analyzed periodically for residual mercaptan sulfur. The results appear in Table I below.

TABLE I

| | Impregnation Solvent | | | | | |
|---|---|---|---|---|---|---|
| | Methanol | | Water | | Water/$NH_3$ | |
| Time, min. | Cat A | Cat B | Cat C | Cat D | Cat E | Cat F |
| 0 | 832 | 832 | 832 | 832 | 832 | 832 |
| 30 | 74 | 62 | 73 | 71 | 66 | 63 |
| 60 | 50 | 35 | 48 | 43 | 42 | 31 |
| 90 | 31 | 21 | 37 | 18 | 24 | 21 |
| 120 | 27 | 12 | 26 | 13 | 21 | 14 |

Properties of Nuchar WA and Darco MRX Charcoals

TABLE I-continued

| | Nuchar, WA | Darco, MRX |
|---|---|---|
| Attrition, wt. % | 3.3 | 0.8 |
| ABD, g/cc | 0.15 | 0.44 |
| Surface Area, $m^2/g$ | 500–600 | 570.0 |
| Pore Volume, ml/g | 1.7 | 0.53 |
| Pore Diameter, A° | 26.0 | 37.0 |

We claim as our invention:

1. A process for treating a mercaptan-containing sour petroleum distillate at oxidation conditions with a metal phthalocyaine oxidation catalyst consisting essentially of a metal phthalocyanine impregnated upon charcoal particles possessing an apparent bulk density of from about 0.25 to about 0.50 grams per cubic centimeter wherein said impregnation of said charcoal particles possessing said apparent bulk density is performed with an aqueous impregnating solution consisting essentially of said metal phthalocyanine dissolved in a solvent consisting essentially of water and wherein said impregnated metal phthalocyanine is then wetted with an aqueous metal hydroxide.

2. The process of claim 1 further characterized in that said metal phthalocyanine is a cobalt phthalocyanine.

3. The process of claim 1 further characterized in that said metal phthalocyanine is a cobalt phthalocyanine sulfonate.

4. The process of claim 1 further characterized in that said metal phthalocyanine is a cobalt phthalocyaine sulfonate comprising the mono- and disulfonate in a molar ratio of from about 0.5:1 to about 1.5:1.

5. The process of claim 1 further characterized in that said metal phthalocyanine-impregnated activated charcoal particles comprise from about 0.1 to about 10 wt.% metal phthalocyanine.

6. The process of claim 1 further characterized in that said activated charcoal particles have an apparent bulk density of from about 0.4 to about 0.5 grams per cubic centimeter.

7. A process for treating a mercaptan-containing sour petroleum distillate at oxidation conditions with a metal phthalocyanine oxidation catalyst consisting essentially of a metal phthalocyanine impregnated upon charcoal particles possessing an apparent bulk density of from about 0.25 to about 0.50 grams per cubic centimeter wherein said impregnation of said charcoal particles possessing said apparent bulk density is performed with an aqueous impregnating solution consisting essentially of said metal phthalocyanine dissolved in a solvent consisting essentially of water and ammonia or ammonium hydroxide in an amount not exceeding 20 volume percent of said water and wherein said impregnated metal phthalocyanine catalyst is then wetted with an aqueous metal hydroxide.

* * * * *

UNITED STATES PATENT AND TRADEMARK OFFICE

CERTIFICATE OF CORRECTION

PATENT NO. : 4,248,694

DATED : February 3, 1981

INVENTOR(S) : DAVID H. J. CARLSON ET AL.

It is certified that error appears in the above-identified patent and that said Letters Patent are hereby corrected as shown below:

Please correct line 12 of claim 1 to read as follows:

"nated metal phthalocyanine catalyst is then wetted with an"

Signed and Sealed this

*Ninth* Day of *June 1981*

[SEAL]

*Attest:*

RENE D. TEGTMEYER

*Attesting Officer*

*Acting Commissioner of Patents and Trademarks*